US005474096A

United States Patent [19]

Dohmen

[11] Patent Number: 5,474,096

[45] Date of Patent: Dec. 12, 1995

[54] DOUBLE BACK ROD

[76] Inventor: Cheri L. L. Dohmen, 23555 Hogan Ave., Hampton, Minn. 55031

[21] Appl. No.: 251,255

[22] Filed: May 31, 1994

[51] Int. Cl.[6] ..... A45D 6/16; A45D 2/14

[52] U.S. Cl. ..... 132/252; 132/251; 132/262

[58] Field of Search ..... 132/252, 251, 132/253, 245, 261, 249, 262

[56] References Cited

U.S. PATENT DOCUMENTS

| | | | |
|---|---|---|---|
| 3,019,797 | 2/1962 | Strys et al. | 132/252 |
| 3,470,888 | 10/1969 | Kuhn | 132/252 |
| 3,881,500 | 5/1975 | Shinbashi | 132/252 |
| 3,913,593 | 10/1975 | Sato | 132/251 |
| 4,513,761 | 4/1985 | Van Deursen | 132/251 |

FOREIGN PATENT DOCUMENTS

| | | | |
|---|---|---|---|
| 2748702 | 5/1979 | Germany | 132/252 |
| 565415 | 7/1957 | Italy | 132/251 |

*Primary Examiner*—John G. Weiss

[57] ABSTRACT

A new and improved double back rod comprising a cylindrical hollow rod having a first end, a second end, and an intermediate extent therebetween. The first end and the second end each having a first end portion, a second end portion, and an intermediate portion therebetween. The intermediate portion is offset from both the first end portion and the second end portion. A plurality of holes are within each intermediate portion. A plurality of air and liquid holes are formed on the intermediate extent of the cylindrical hollow rod. A plurality of hair grippers are formed on the intermediate extent of the cylindrical hollow rod. The hair grippers function to help grab a head of hair. The device contains a first clip and a second clip. Both the first clip and the second clip have a rubber end and a curvilinear end. A plurality of projections are formed on each curvilinear end. The projections cooperate with the plurality of holes formed on the intermediate portion of the cylindrical hollow rod to secure the first clip and the second clip to the cylindrical hollow portion.

2 Claims, 3 Drawing Sheets

FIG. 1
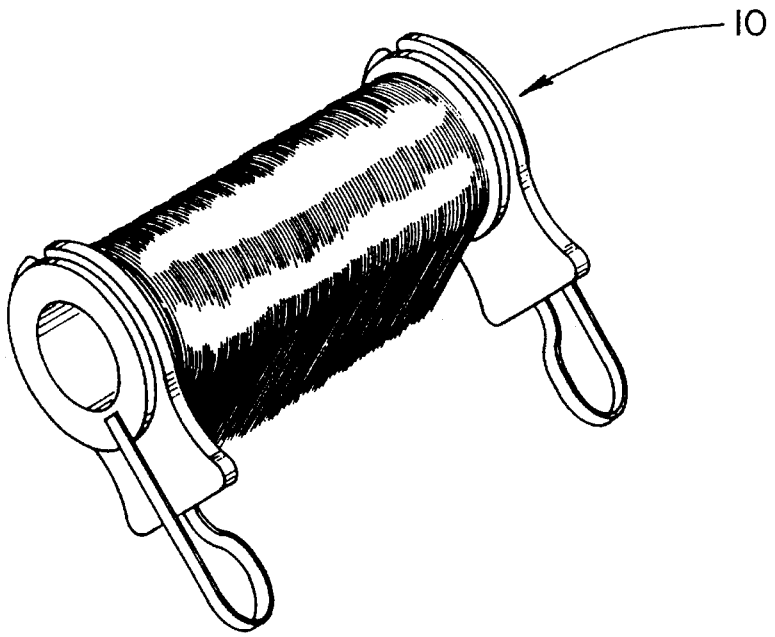
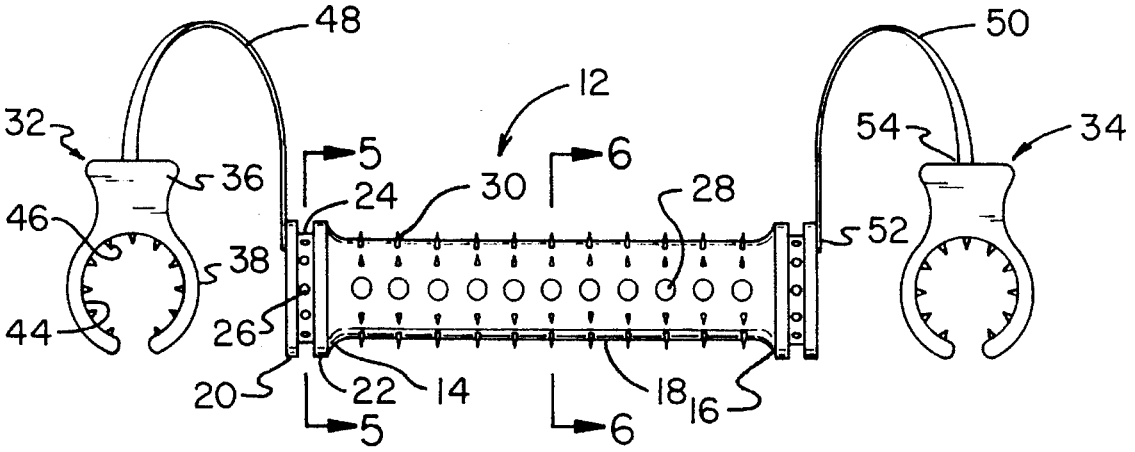
FIG. 2

DOUBLE BACK ROD

BACKGROUND OF THE INVENTION

1. Field of the Invention

The present invention relates to a double back rod and more particularly pertains to providing a perm rod for performing a perm on longer hair easily and in less time with a double back rod.

2. Description of the Prior Art

The use of permanent wave rods is known in the prior art. More specifically, permanent wave rods heretofore devised and utilized for the purpose of giving a perm are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,993,441 to Hanson discloses a permanent wave rod.

U.S. Pat. No. 4,533,328 to McDaniel discloses a permanent wave or hair curling rod and associated hair curl display device.

U.S. Pat. No. 4,742,835 to Boweter discloses a permanent wave rod.

U.S. Pat. No. 4,644,965 to Alexander discloses a permanent wave hair rod.

U.S. Pat. No. Des. 329,303 to Asakura discloses the design of a perming rod.

U.S. Pat. No. Des. 259,816 to Sledge discloses the design of a permanent wave rod.

While these devices fulfill their respective, particular objective and requirements, the aforementioned patents do not describe a double back rod that providing a perm rod for performing a perm on longer hair easily and in less time.

In this respect, the double back rod according to the present invention substantially departs from the conventional concepts and designs of the prior art, and in doing so provides an apparatus primarily developed for the purpose of providing a perm rod for performing a perm on longer hair easily and in less time.

Therefore, it can be appreciated that there exists a continuing need for new and improved double back rod which can be used for providing a perm rod for performing a perm on longer hair easily and in less time. In this regard, the present invention substantially fulfills this need.

SUMMARY OF THE INVENTION

In the view of the foregoing disadvantages inherent in the known types of permanent wave rods now present in the prior art, the present invention provides an improved double back rod. As such, the general purpose of the present invention, which will be described subsequently in greater detail, is to provide a new and improved double back rod and method which has all the advantages of the prior art and none of the disadvantages.

To attain this, the present invention essentially comprises a cylindrical hollow rod having a first end, a second end, and an intermediate extent therebetween. The first end and the second end each have a first end portion, a second end portion, and an intermediate portion therebetween. The intermediate portion is offset from both the first end portion and the second end portion. A plurality of holes are within each intermediate portion. A plurality of air and liquid holes are formed on the intermediate extent of the cylindrical hollow rod. A plurality of hair grippers are formed on the intermediate extent of the cylindrical hollow rod. The hair grippers function to help grab a head of hair. The device contains a first clip and a second clip. Both the first clip and the second clip have a rubber end and a curvilinear end. The curvilinear end has an internal surface, an external surface, and an inner sidewall. The internal surface is a flexible metal material. The external surface is a rubber material. A plurality of projections are formed on the inner sidewall of the curvilinear end. The projections cooperate with the plurality of holes formed on the intermediate portion of the cylindrical hollow rod to secure the first clip and the second clip to the respective first end and second end of the cylindrical hollow portion. The device also consists of a first rubber band and a second rubber band. Both the first rubber band and the second rubber band have a first end and a second end. The first end of the first rubber band is secured to the first end portion of the first end of the cylindrical hollow rod. The second end of the first rubber band is secured to the rubber end of the first clip. The first end of the second rubber band is secured to the first end portion of the second end of the cylindrical hollow rod. The second end of the second rubber band is secured to the rubber end of the second clip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved double back rod which has all the advantages of the prior art permanent wave rods and none of the disadvantages.

It is another object of the present invention to provide a new and improved double back rod which may be easily and efficiently manufactured and marketed.

It is a further object of the present invention to provide a new and improved double back rod which is of durable and reliable construction.

An even further object of the present invention is to provide a new and improved double back rod which is susceptible of a low cost of manufacture with regard to both materials and labor, and which accordingly is then susceptible of low prices of sale to the consuming public, thereby making such a double back rod economically available to the buying public.

Still yet another object of the present invention is to provide a new and improved double back rod which provides in the apparatuses and methods of the prior art some of the advantages thereof, while simultaneously overcoming some of the disadvantages normally associated therewith.

Even still another object of the present invention is to provide a new and improved double back rod for providing a perm rod for performing a perm on longer hair easily and in less time.

Lastly, it is an object of the present invention to provide a new and improved double back rod comprising a cylindrical hollow rod having a first end, a second end, and an intermediate extent therebetween. The first end and the second end each having a first end portion, a second end portion, and an intermediate portion therebetween. The intermediate portion is offset from both the first end portion and the second end portion. A plurality of holes are within each intermediate portion. A plurality of air and liquid holes are formed on the intermediate extent of the cylindrical hollow rod. A plurality of hair grippers are formed on the intermediate extent of the cylindrical hollow rod. The hair grippers function to help grab a head of hair. The device contains a first clip and a second clip. Both the first clip and the second clip have a rubber end and a curvilinear end. A plurality of projections are formed on each curvilinear end. The projections cooperate with the plurality of holes formed on the intermediate portion of the cylindrical hollow rod to secure the first clip and the second clip to the cylindrical hollow portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the double back rod constructed in accordance with the principles of the present invention.

FIG. 2 is a plan view of the preferred embodiment of the present invention.

The same reference numerals refer to the same parts through the various Figures.

DESCRIPTION OF THE PREFERRED EMBODIMENT

Figure 3:
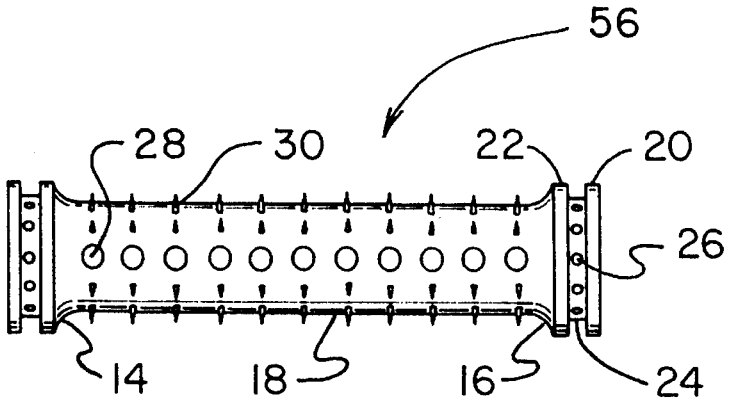
FIG. 3 is a plan view of the rod of the present invention.

With reference now to the drawings, and in particular, to FIG. 1 thereof, the preferred embodiment of the new and improved double back rod embodying the principles and concepts of the present invention and generally designated by the reference number 10 will be described.

Specifically, it will be noted in the various Figures that the device relates to a double back rod. In its broadest context, the device consists of a cylindrical hollow rod, a plurality of air and liquid holes, a first and second clip, and a first and second rubber band.

The device 10 contains a cylindrical hollow rod 12 having a first end 14, a second end 16, and an intermediate extent 18 therebetween. The first end 14 and the second end 16 each have a first end portion 20, a second end portion 22, and an intermediate portion 24 therebetween. The intermediate portion 24 is offset from both the first end portion 20 and the second end portion 22. A plurality of holes 26 are within each intermediate portion 24.

A plurality of air and liquid holes 28 are formed on the intermediate extent 18 of the cylindrical hollow rod 12. A plurality of hair grippers 30 are formed on the intermediate extent 18 of the cylindrical hollow rod 12. The hair grippers 30 function to help grab a head of hair.

The device 10 contains a first clip 32 and a second clip 34. Both the first clip 32 and the second clip 34 have a rubber end 36 and a curvilinear end 38. The curvilinear end 38 has an internal surface 40, an external surface 42, and an inner sidewall 44. The internal surface 40 is a flexible metal material. The external surface 42 is a rubber material. A plurality of projections 46 are formed on the inner sidewall 44 of the curvilinear end 38. The projections 46 cooperate with the plurality of holes 26 formed on the intermediate portion 24 of the cylindrical hollow rod 12 to secure the first clip 32 and the second clip 34 to the respective first end 14 and second end 16 of the cylindrical hollow portion 12.

The device also consists of a first rubber band 48 and a second rubber band 50. Both the first rubber band 48 and the second rubber band 50 have a first end 52 and a second end 54. The first end 52 of the first rubber band 48 is secured to the first end portion 20 of the first end 14 of the cylindrical hollow rod 12. The second end 54 of the first rubber band 48 is secured to the rubber end 36 of the first clip 32. The first end 52 of the second rubber band 50 is secured to the first end portion 20 of the second end 16 of the cylindrical hollow rod 12. The second end 54 of the second rubber band 50 is secured to the rubber end 36 of the second clip 34.

Figure 4:
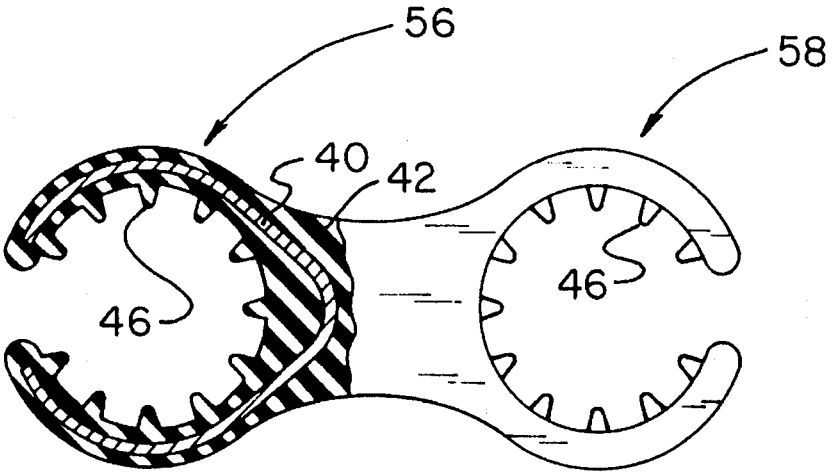
FIG. 4 is a plan view of the double clip of the second embodiment of the present invention.
Figure 5:
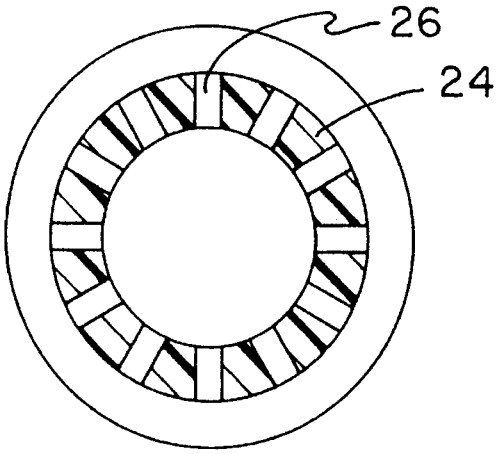
FIG. 5 is a cross-sectional view as seen along line 5—5 of FIG. 2.
Figure 6:
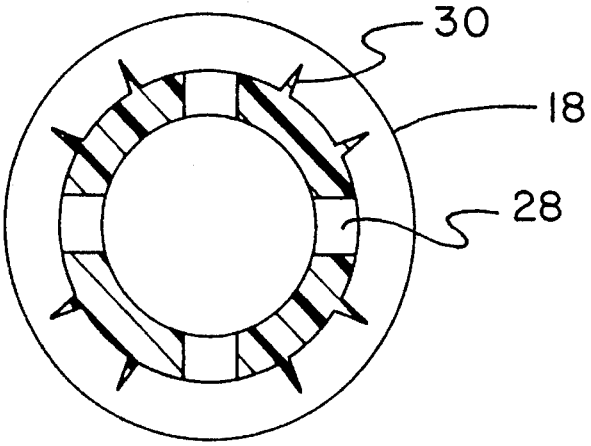
FIG. 6 is a cross-sectional view as seen along line 6—6 of FIG. 2.

A second embodiment of the present invention is shown in FIG. 3 and 4 and includes substantially all of the components of the present invention further including a second cylindrical hollow rod 56 having a first end 12, a second end 14, and an intermediate extent 18 therebetween. The first end 12 and the second end 14 each having a first end portion 20, a second end portion 22, and an intermediate portion 24 therebetween. The intermediate portion 24 being offset from both the first end portion 20 and the second end portion 22.

A plurality of holes 26 are within each intermediate portion 24.

The first clip 32 and the second clip 34 both of which have a first curvilinear end 56 and a second curvilinear end 58. A plurality of projections 46 are formed on the first curvilinear end 56 and the second curvilinear end 58. The projections 46 of each first curvilinear end 56 cooperate with the plurality of holes 26 formed on the intermediate portion 24 of the cylindrical hollow rod 12. The projections 26 of each second curvilinear end 58 cooperate with the plurality of holes 26 on the intermediate portion 24 of the second cylindrical portion 56.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A double back rod comprising, in combination:

a cylindrical hollow rod having a first end, a second end, and an intermediate extent therebetween, the first end and the second end each having a first end portion, a second end portion, and an intermediate portion therebetween, the intermediate portion being offset from both the first end portion and the second end portion, a plurality of holes within each intermediate portion;

a plurality of air and liquid holes formed on the intermediate extent of the cylindrical hollow rod, a plurality of hair grippers formed on the intermediate extent of the cylindrical hollow rod, the hair grippers functioning to help grab a head of hair;

a first clip and a second clip, both the first clip and the second clip having a rubber end and a curvilinear end, the curvilinear end having an internal surface, an external surface, and an inner sidewall, the internal surface being a flexible metal material, the external surface being a rubber material, a plurality of projections formed on the inner sidewall of the curvilinear end, the projections cooperating with the plurality of holes formed on the intermediate portion of the cylindrical hollow rod to secure the first clip and the second clip to the respective first end and second end of the cylindrical hollow portion;

a first rubber band and a second rubber band, both the first rubber band and the second rubber band having a first end and a second end, the first end of the first rubber band secured to the first end portion of the first end of the cylindrical hollow rod, the second end of the first rubber band secured to the rubber end of the first clip, the first end of the second rubber band secured to the first end portion of the second end of the cylindrical hollow rod, the second end of the second rubber band secured to the rubber end of the second clip.

2. A double back rod comprising, in combination:

a cylindrical hollow rod having a first end, a second end, and an intermediate extent therebetween, the first end and the second end each having a first end portion, a second end portion, and an intermediate portion therebetween, the intermediate portion being offset from both the first end portion and the second end portion., a plurality of holes within each intermediate portion;

a plurality of air and liquid holes formed on the intermediate extent of the cylindrical hollow rod, a plurality of hair grippers formed on the intermediate extent of the cylindrical hollow rod, the hair grippers functioning to help grab a head of hair;

a first clip and a second clip, each of the first clip and the second clip having a rubber end and a curvalinear end, a plurality of projections formed on each curvalinear end, the projections cooperating with the plurality of holes formed on the intermediate portion of the cylindrical hollow rod to secure the first clip and the second clip to the cylindrical hollow portion, and a first rubber band and a second rubber band, the first rubber band secured to the first end portion of the cylindrical hollow rod and the first clip, the second rubber band secured to the second end portion of the cylindrical hollow rod and the second clip.

* * * * *